US010831130B2

(12) United States Patent
Sakamoto

(10) Patent No.: US 10,831,130 B2
(45) Date of Patent: Nov. 10, 2020

(54) DEVELOPING DEVICE AND IMAGE FORMING APPARATUS

(71) Applicant: FUJI XEROX CO., LTD., Tokyo (JP)

(72) Inventor: Takashi Sakamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/531,235

(22) Filed: Aug. 5, 2019

(65) Prior Publication Data

US 2020/0301314 A1 Sep. 24, 2020

(30) Foreign Application Priority Data

Mar. 22, 2019 (JP) ..... 2019-054474

(51) Int. Cl.
*G03G 15/08* (2006.01)

(52) U.S. Cl.
CPC ..... *G03G 15/0881* (2013.01); *G03G 15/0812* (2013.01)

(58) Field of Classification Search
CPC ..... G03G 15/0817; G03G 15/0898; G03G 15/0942
USPC ..... 399/103
See application file for complete search history.

(56) References Cited

U.S. PATENT DOCUMENTS 5,475,467 A * 12/1995 Watanabe ..... G03G 15/0817 399/111
6,144,820 A * 11/2000 Ishii ..... G03G 15/0898 399/103
2012/0269544 A1* 10/2012 Tsuda ..... G03G 15/0942 399/111
2014/0079432 A1* 3/2014 Matsuzaki ..... G03G 15/0874 399/106

FOREIGN PATENT DOCUMENTS

JP 2000-066506 A 3/2000
JP 2004-317567 A 11/2004
JP 2005-201943 A 7/2005
JP 2009-157117 A 7/2009

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A developing device includes a developer carrier, a sheet-shaped insulating seal member, and an electroconductive film. The developer carrier holds a developer with which an electrostatic latent image formed on an image carrier is developed. The seal member is disposed above the developer carrier and at a portion that is not in contact with the held developer. The seal member has a first end portion fixed and a second end portion in contact with the image carrier. The electroconductive underlies an undersurface of the seal member at a portion that is not in contact with the developer held by the developer carrier. The electroconductive film has a first end portion connected to the first end portion of the seal member and a second end portion not in contact with the image carrier.

15 Claims, 6 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-054474 filed Mar. 22, 2019.

BACKGROUND

(i) Technical Field

The present disclosure relates to a developing device and an image forming apparatus.

(ii) Related Art

Japanese Unexamined Patent Application Publication No. 2005-201943 discloses a technology of a developing device for preventing toner from falling on a sheet surface or in an apparatus. The device of this technology includes a developer carrier, a developer regulator that regulates the layer thickness of a developer carried on the developer carrier, and a developing device that includes a toner-dispersion-preventative shield board disposed near a development nip at which a developer layer having a thickness regulated by the developer regulator is in contact with an electrostatic image carrier. A flexible member is disposed a predetermined distance apart from the developer layer having a thickness regulated by the developer regulator within a range from the developer regulator to the development nip. At least a surface of the flexible member facing the developer carrier is electroconductive.

Other related technologies are disclosed in Japanese Unexamined Patent Application Publication No. 2004-317567, Japanese Unexamined Patent Application Publication No. 2009-157117, and Japanese Unexamined Patent Application Publication No. 2000-066506.

SUMMARY

In a structure in which a sheet-shaped insulating seal member disposed above the developer carrier and at a portion that is not in contact with the held developer is in contact with the image carrier, the developer may fall on the developer carrier.

Aspects of non-limiting embodiments of the present disclosure relate to a structure that prevents a developer from falling on a developer carrier unlike a structure including only a sheet-shaped insulating seal member disposed above the developer carrier and at a portion that is not in contact with the held developer.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device that includes a developer carrier that holds a developer with which an electrostatic latent image formed on an image carrier is developed; a sheet-shaped insulating seal member disposed above the developer carrier and at a portion that is not in contact with the held developer, the seal member having a first end portion fixed and a second end portion in contact with the image carrier; and an electroconductive film that underlies an undersurface of the seal member at a portion that is not in contact with the developer held by the developer carrier, the electroconductive film having a first end portion connected to the first end portion of the seal member and a second end portion not in contact with the image carrier.

BRIEF DESCRIPTION OF THE DRAWINGS

Exemplary embodiments of the present disclosure will be described in detail based on the following figures, wherein.

DETAILED DESCRIPTION

Exemplary Embodiment

An image forming apparatus according to one exemplary embodiment of the present disclosure will be described. A front-rear direction of the apparatus is referred to as a X direction and denoted with arrow X, a lateral direction of the apparatus is referred to as a Y direction and denoted with arrow Y, and a vertical direction of the apparatus is referred to as a Z direction and denoted with arrow Z. Throughout the drawings, an encircled dot refers to arrow Y perpendicular to the sheet surface. The left side of the X direction in FIG. 1 is referred to as a front side, a side of the Y direction from the back of the sheet to the top of the sheet is referred to as a right side, an upper side of the Z direction is referred to as an upper side, and the sides opposite to these sides are respectively referred to as a rear side, a left side, and a lower side.

Entire Structure

First, the entire structure of an image forming apparatus 10 will be described.

Figure 1:
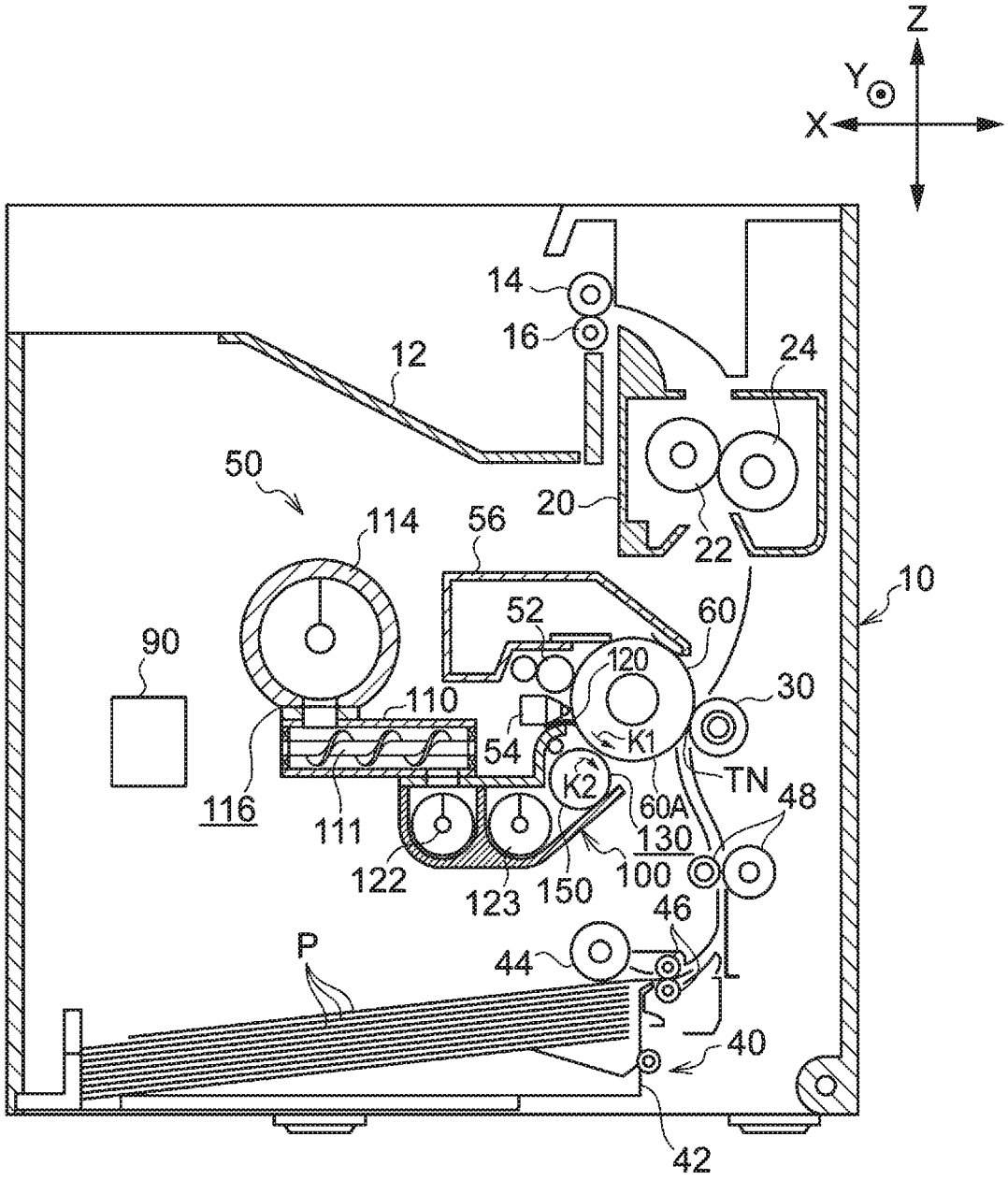
FIG. 1 illustrates a structure of an image forming apparatus according to an exemplary embodiment.

As illustrated in FIG. 1, the image forming apparatus 10 includes components such as an image forming unit 50, a power supply device 90, a fixing device 20, and a sheet feeder 40.

The image forming unit 50 includes a photoconductor 60, a transfer roller 30, a charging device 52, a light exposure device 54, a developing device 100 (also refer to FIG. 2), and a cleaning device 56. The charging device 52, which is an example of a charging member, charges an outer circumferential surface 60A of the hollow cylindrical photoconductor 60, which is an example of an image carrier. The light exposure device 54, which is an example of an electrostatic-latent-image forming member, forms an electrostatic latent image on the photoconductor 60 by irradiating the charged outer circumferential surface 60A of the photoconductor 60 with light based on image data. The cleaning device 56 removes and reclaims, for example, toner remaining on the photoconductor 60 from which a toner image has been transferred. The transfer roller 30 receives a transfer voltage from the power supply device 90, and transfers a toner image, which is an example of a developer image, formed on the outer circumferential surface 60A of the photoconductor 60 at a transfer nip TN to a sheet medium P transported along a transport path.

The developing device 100 selectively transfers toner, which is an example of a developer, to the electrostatic latent image formed on the photoconductor 60 to render the latent image visible as a toner image. The detail of the developing device 100 will be described, below.

The fixing device 20 include a heating roller 22 and a pressing roller 24. When a sheet medium P passes through a gap between the heating roller 22 and the pressing roller 24, a toner image transferred to the sheet medium P is fixed to the sheet medium P with heat and pressure.

On a downstream side of the fixing device 20 in a transport direction, components such as discharging rollers 14 and 16, which discharge the sheet medium P on which the toner image has been fixed to a discharge portion 12, are disposed.

The sheet feeder 40, which feeds sheet media P one by one, is disposed at a lower portion of the image forming apparatus 10. The sheet feeder 40 includes a container unit 42, which accommodates a stack of multiple sheet media P such as recording sheets, which are an example of a recording medium. The sheet media P stacked in the container unit 42 are sequentially picked up by a pickup roller 44 and separation rollers 46 and transported one by one. The sheet media P are transported to a downstream side in a transport direction along a transport path for the sheet media P.

The transported sheet media P are transported to a transfer nip TN at predetermined timing by a pair of registration rollers 48 disposed on the transport path.

Image Forming Step

An image forming step of the image forming apparatus 10 will now be described.

Firstly, the charging device 52 charges the outer circumferential surface 60A of the photoconductor 60. Then, the light exposure device 54 exposes the charged outer circumferential surface 60A of the photoconductor 60 with light based on image data read by a scanner, not illustrated, or data transmitted from the outside to form an electrostatic latent image on the outer circumferential surface 60A of the photoconductor 60. Then, the developing device 100 develops the electrostatic latent image into a toner image, which is a visible image.

The sheet media P are fed from the container unit 42 to the transport path. The sheet media P fed to the transport path are each transported at predetermined timing by the pair of registration rollers 48 to the transfer nip TN, between the transfer roller 30 and the photoconductor 60 holding a toner image, and the toner image is transferred to the sheet medium P by the transfer roller 30.

The toner image transferred to the sheet medium P passes through a gap between the heating roller 22 and the pressing roller 24 of the fixing device 20 to be fixed to the sheet medium P. The sheet medium P to which the toner image has been fixed is discharged to the discharge portion 12 by the discharging rollers 14 and 16.

Details of Developing Device

The developing device 100 will now be described in detail, below. The rotation direction of the photoconductor 60 is denoted with arrow K1, and the rotation direction of a development roller 150, described below, is denoted with arrow K2.

Figure 2:
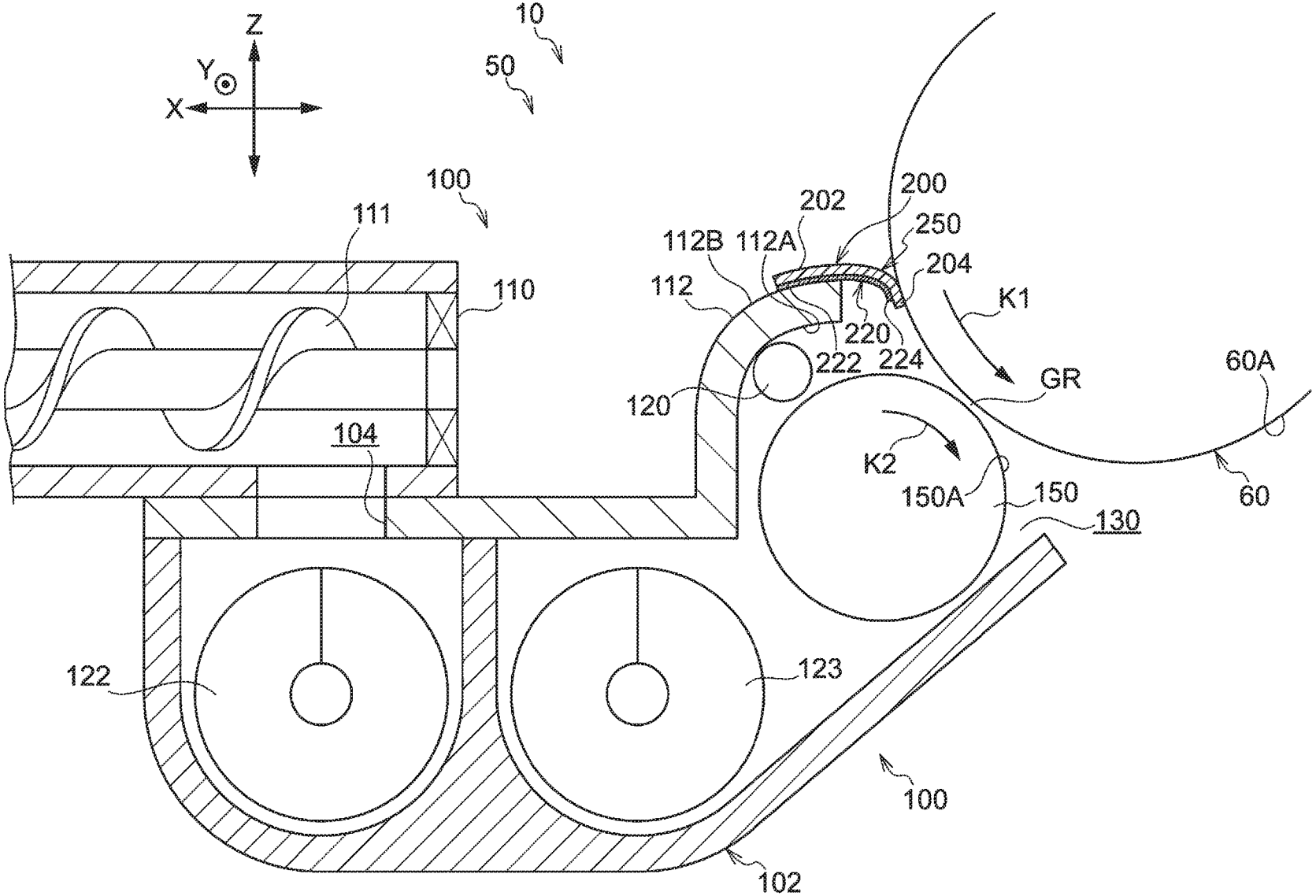
FIG. 2 illustrates a structure of a developing device in FIG. 1.
Figure 3:
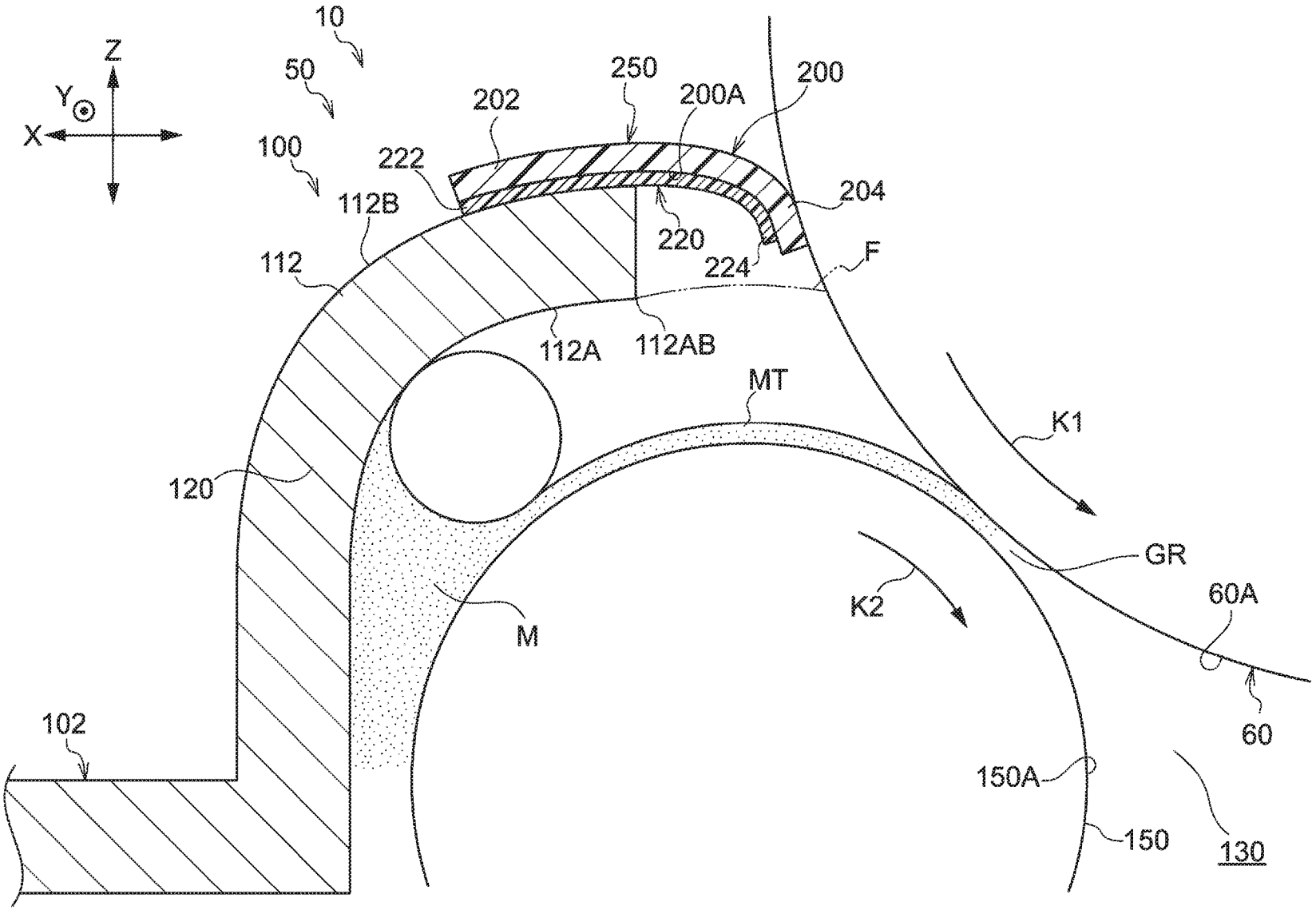
FIG. 3 illustrates a structure of a related portion of the developing device in FIG. 2 in an enlarged manner.

As illustrated in FIG. 1 and FIG. 2, the developing device 100 includes a development container 102, which accommodates toner M (refer to FIG. 3). The toner M is an example of a developer. A toner feed port 104, which is an example of a feed unit, is formed on an upper surface of the development container 102 on the front side. A tubular toner feed path 110 is connected to the toner feed port 104. A toner transport member 111 is rotatably supported inside the toner feed path 110.

As illustrated in FIG. 1, a toner cartridge 114, which is an example of a toner container, is detachably connected to the front end portion of the toner feed path 110. Toner flows into the toner feed path 110 from an outlet port 116 of the toner cartridge 114.

As illustrated in FIG. 1 and FIG. 2, a pair of circulating transport members 122 and 123, which are an example of an agitating member, extend in the Y direction in the development container 102.

Inside the development container 102, the development roller 150, which is an example of a developer carrier, extends in the Y direction. The development roller 150 includes a magnet roll including multiple magnetic polarities inside. The toner M (refer to FIG. 3) is held on an outer circumferential surface 150A of the development roller 150 with the magnetic force of the magnet roll. The magnet roll is not illustrated.

As illustrated in FIG. 2 and FIG. 3, the development container 102 has an opening 130 at a portion facing the photoconductor 60. Part of the development roller 150 is exposed through the opening 130. The development container 102 has a curved portion 112 above the development roller 150. The curved portion 112 is spaced apart from the outer circumferential surface 150A of the development roller 150. An end of the curved portion 112 close to the photoconductor 60 forms an upper edge portion of the opening 130.

A rod-shaped regulating member 120 is disposed in the development container 102 to face the outer circumferential surface 150A of the development roller 150. The regulating member 120 is disposed on an inner wall surface 112A of the curved portion 112 of the development container 102 that faces the outer circumferential surface 150A of the development roller 150. When the toner M passes through a gap between the regulating member 120 and the outer circumferential surface 150A of the development roller 150, the amount of the toner M transported to a development area GR facing the photoconductor 60 is regulated, and a toner layer MT is concurrently formed.

The layer thickness of the toner layer MT in FIG. 3, a gap between the outer circumferential surface 150A of the development roller 150 and the regulating member 120, and a gap between the outer circumferential surface 150A of the development roller 150 and the outer circumferential surface 60A of the photoconductor 60 do not precisely show the actual thickness and gaps. A magnetic brush or the like forming the toner layer MT may be in contact with the inner wall surface 112A.

Figure 5:
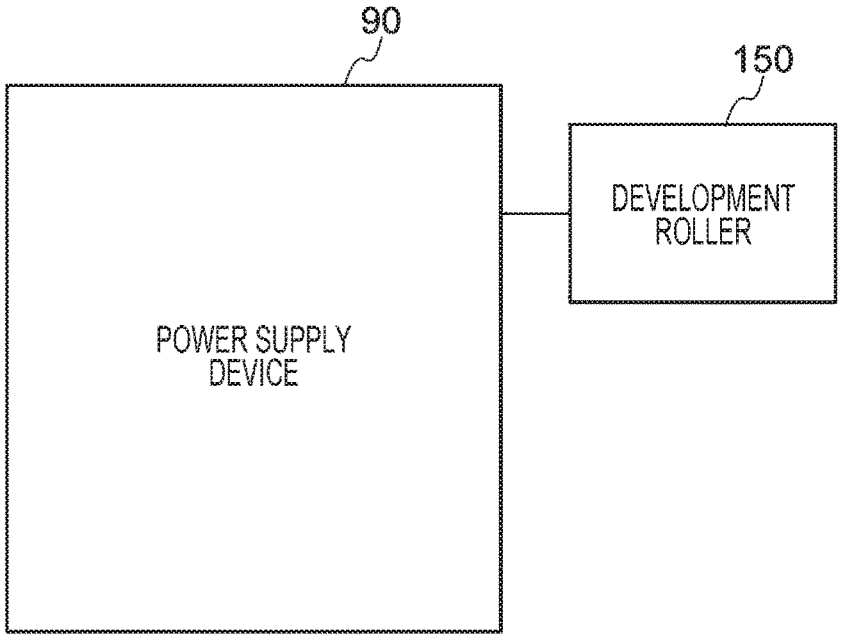
FIG. 5 is a block diagram of a power supply device and a development roller.

As illustrated in FIG. 5, the development roller 150 is electrically connected to the power supply device 90 (also refer to FIG. 1), and receives a development bias that is an AC voltage on which a DC voltage is superposed. The DC voltage has the same polarity as the electric polarity with which the toner M is charged.

In the development area GR in which the outer circumferential surface 150A of the development roller 150 and the outer circumferential surface 60A of the photoconductor 60 illustrated in FIG. 2 and FIG. 3 face each other adjacent to each other, an electrostatic latent image of the photoconductor 60 is developed with the toner M with a development bias to be rendered visible.

A first end portion 202 of a sheet-shaped insulating seal member 200 is fixed to an outer wall surface 112B of the curved portion 112 of the development container 102. A second end portion 204 of the seal member 200 is in contact with the outer circumferential surface 60A of the photoconductor 60, and curved in a rotation direction of the photoconductor 60.

An electroconductive film 220 underlies an undersurface 200A of the seal member 200. A first end portion 222 of the electroconductive film 220 underlies the first end portion 202 of the seal member 200, and is fixed to the outer wall surface 112B of the curved portion 112. The electroconductive film 220 is shorter than the seal member 200, and a second end portion 224 of the electroconductive film 220 is not in contact with the outer circumferential surface 60A of the photoconductor 60. The second end portion 224 of the electroconductive film 220 is curved along the second end portion 204 of the seal member 200.

Figure 4B:
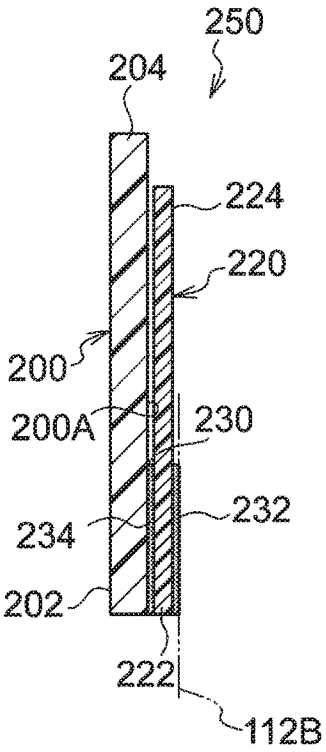
FIG. 4B is a cross-sectional view of the seal assembly.
Figure 4A:
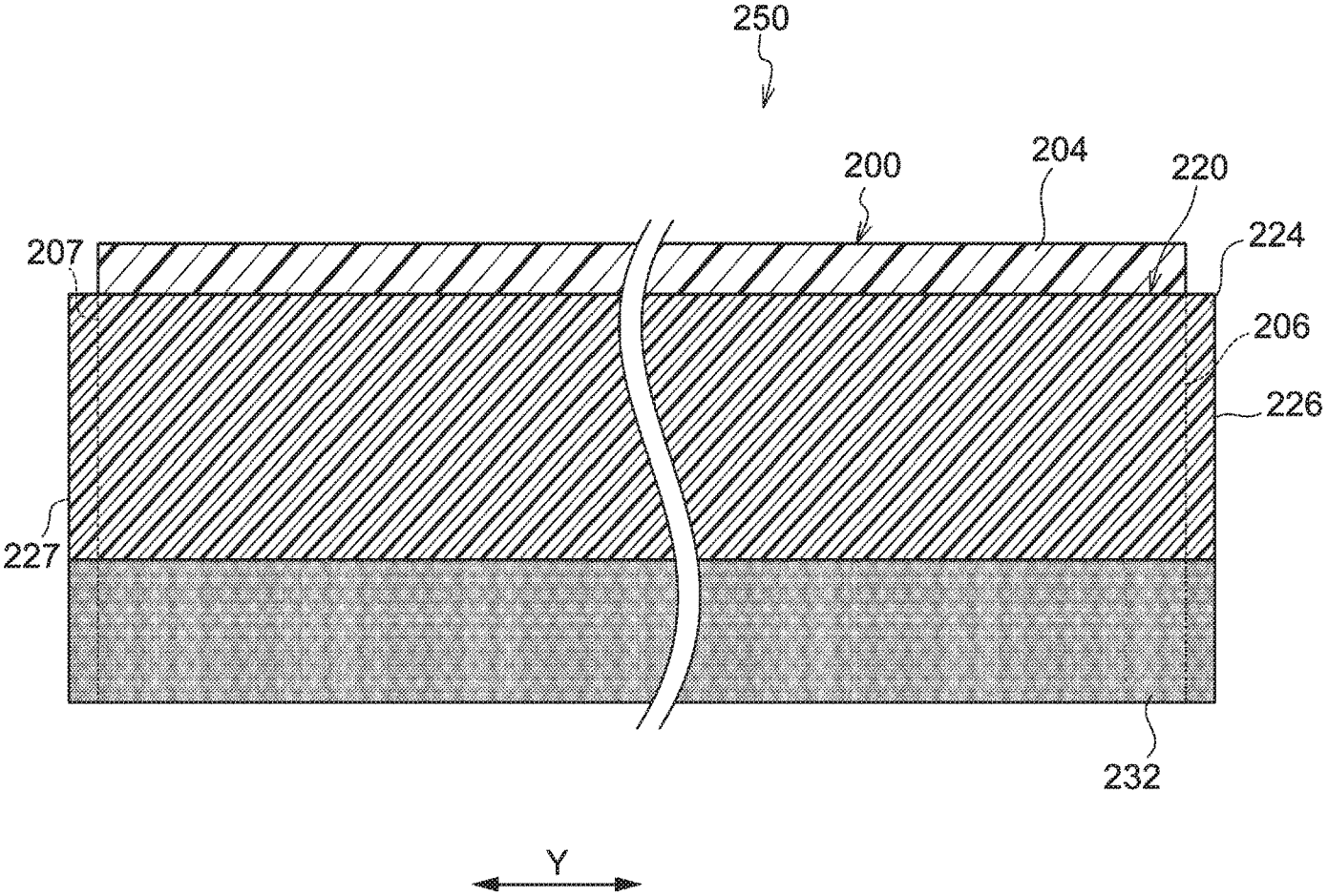
FIG. 4A is a plan view of a seal assembly.

As illustrated in FIG. 4A, side end portions 226 and 227 of the electroconductive film 220 protrude outward in the widthwise direction beyond side end portions 206 and 207 of the seal member 200. In the state where the seal member 200 and the electroconductive film 220 are fixed to the development container 102, the widthwise direction corresponds to the Y direction, which is the same as the axial direction of the photoconductor 60 and the development roller 150. The in-plane direction perpendicular to the widthwise direction is referred to as a lengthwise direction.

In the exemplary embodiment, the electroconductive film 220 electrically floats.

As illustrated in FIG. 2 and FIG. 3, the seal member 200 and the electroconductive film 220 are disposed above the outer circumferential surface 150A of the development roller 150 at a portion exposed through the opening 130 at a position at which they do not come into contact with the toner layer MT held by the outer circumferential surface 150A. In other words, the seal member 200 and the electroconductive film 220 are disposed on the radially outer side of the developer M between the regulating member 120 and the development area GR.

From another point of view, as illustrated in FIG. 3, the seal member 200 and the electroconductive film 220 are disposed above the outer circumferential surface 150A of the development roller 150 at a portion exposed through the opening 130, and disposed on the radially outer side of a virtual curve F. The virtual curve F is concentric with the outer circumferential surface 150A of the development roller 150, and passes an opening end 112AB of the inner wall surface 112A of the curved portion 112 of the development container 102 facing the outer circumferential surface 150A, between the regulating member 120 and the development area GR.

The expression of "above the outer circumferential surface 150A of the development roller 150 at a portion exposed through the opening 130" may be rephrased with a state where, in a plan view, the seal member 200 and the electroconductive film 220 overlap the outer circumferential surface 150A of the development roller 150 at a portion exposed through the opening 130.

In the present exemplary embodiment, the first end portion 222 of the electroconductive film 220 is bonded to the outer wall surface 112B of the curved portion 112 with a double-sided tape 232 (refer to FIG. 4B), and the first end portion 202 of the seal member 200 is bonded onto the first end portion 222 of the electroconductive film 220 with a double-sided tape 234 (refer to FIG. 4B).

Thus, in the present exemplary embodiment, the seal member 200 and the electroconductive film 220 are bonded together at only the first end portions 202 and 222, and leave the other area unbonded although being in contact with each other in a curved state. The expression of "the first end portions 202 and 222" in the present exemplary embodiment refer to the entirety or part of the portion not protruding from the outer wall surface 112B toward the photoconductor 60.

As illustrated in FIG. 4, in the present exemplary embodiment, the first end portion 202 of the seal member 200 and the first end portion 222 of the electroconductive film 220 are integrated together in advance with the double-sided tape 234 (refer to FIG. 4B), and the double-sided tape 232 is bonded to the first end portion 222 of the electroconductive film 220, to form a seal assembly 250.

FIG. 4A is a bottom view, but includes hatching as in FIG. 4B, for easy understanding. The seal member 200 and the electroconductive film 220 are illustrated without in contact with each other in FIG. 4B for easy understanding, but are actually in contact with each other, as described above.

As illustrated in FIG. 2 and FIG. 3, the seal assembly 250 is bonded to the outer wall surface 112B of the curved portion 112 with the double-sided tape 232 (refer to FIGS. 4A and 4B). Thus, a stack of the seal member 200 and the electroconductive film 220 is fixed to the outer wall surface 112B of the curved portion 112.

The electroconductive film 220 is thinner than the seal member 200, and has a thickness of equal to or smaller than a half of the thickness of the seal member 200, in the present exemplary embodiment. The electroconductive film 220 has smaller flexural rigidity than the seal member 200, and has flexural rigidity of equal to or smaller than a half of the flexural rigidity of the seal member 200, in the present exemplary embodiment.

In the present exemplary embodiment, the insulating seal member 200 is formed from a polyurethane sheet with a thickness of approximately 100 μm and an electrical resistance of $2\times10^{11}$ to $10^{15}\Omega$. In the exemplary embodiment, the electroconductive film 220 is formed from CARBONFEATHER (registered trademark), which is a sheet medium made of polyethylene terephthalate having an electroconductive layer on its surface, and has a thickness of approximately 41 μm and an electrical resistance of $10^{4}\Omega$.

Operation

An operation of the present exemplary embodiment will now be described.

When the electroconductive film 220 does not underlies the undersurface 200A of the seal member 200, that is, when only the seal member 200 is disposed, a large amount of floating toner formed by dispersing of the toner M held on the outer circumferential surface 150A of the development roller 150 may electrostatically adhere to the undersurface 200A of the seal member 200.

When the floating toner adhering to the undersurface 200A of the seal member 200 falls by vibrations or other causes and adheres to a toner layer MT formed by the regulating member 120 on the outer circumferential surface 150A of the development roller 150, the floating toner adheres to the photoconductor 60 in a development area GR and degrades the image quality.

In the exemplary embodiment, however, the electroconductive film 220 underlies the undersurface 200A of the seal member 200. Thus, floating toner is prevented from electrostatically adhering to the seal member 200 and the electroconductive film 220. This structure prevents falling of the floating toner adhering to the seal member 200 and the electroconductive film 220 onto the toner layer MT, and the degradation of image quality.

The seal member 200 has the second end portion 204 in contact with the photoconductor 60, and thus has a reliable sealing effect. In addition, the electroconductive film 220 is shorter than the seal member 200 and not in contact with the photoconductor 60. Thus, an electrostatic latent image formed on the photoconductor 60 is not disturbed.

In this case, toner is prevented from falling on the toner layer MT held by the development roller 150 unlike in the structure that includes only the seal member 200 disposed above the development roller 150 and at a position at which the held toner M is not in contact.

The side end portions 226 and 227 of the electroconductive film 220 extend outward in the widthwise direction beyond the side end portions 206 and 207 of the seal member 200. This structure prevents floating toner from electrostatically adhering to the undersurface 200A of the seal member 200, unlike the structure in which the side end portions 206 and 207 of the seal member 200 extend outward in the widthwise direction beyond the side end portions 226 and 227 of the electroconductive film 220 so that the side end portions 206 and 207 of the seal member 200 are exposed.

The electroconductive film 220 is thinner than the seal member 200. Thus, unlike in the case where the electroconductive film 220 is thicker than the seal member 200, the electroconductive film 220 bends along the curve of the seal member 200 having the second end portion 204 in contact with the photoconductor 60. Thus, the seal member 200 retains the curved shape, and secures the sealing effect.

The electroconductive film 220 has a thickness that is equal to or smaller than a half of the thickness of the seal member 200. Thus, unlike in the case where the electroconductive film 220 is thicker than a half of the thickness of the seal member 200, the seal member 200 having the second end portion 204 in contact with the photoconductor 60 further effectively retains the curved shape, and thus further effectively secures the sealing effect.

The electroconductive film 220 has smaller flexural rigidity than the seal member 200. Unlike in the case where the electroconductive film 220 has larger flexural rigidity than the seal member 200, the electroconductive film 220 curves along the curve of the seal member 200 having the second end portion 204 in contact with the photoconductor 60. Thus, the seal member 200 retains the curved shape, and secures the sealing effect.

Furthermore, the electroconductive film 220 has flexural rigidity that is equal to or smaller than a half of the flexural rigidity of the seal member 200. Thus, unlike in the case where the electroconductive film 220 has flexural rigidity greater than a half of the flexural rigidity of the seal member 200, the seal member 200 having the second end portion 204 in contact with the photoconductor 60 further effectively retains the curved shape, and thus further effectively secures the sealing effect.

In the exemplary embodiment, the seal member 200 and the electroconductive film 220 are bonded at only the first end portions 202 and 222. Thus, compared to the case where the seal member 200 and the electroconductive film 220 are bonded together throughout the surfaces, the electroconductive film 220 more easily follows the curved shape of the seal member 200 having the second end portion 204 in contact with the photoconductor 60. Thus, the seal member 200 effectively retains the curved shape, and secures the sealing effect.

The electroconductive film 220 electrically floats. Thus, compared to the case where the electroconductive film 220 is electrically grounded, floating toner is further prevented from electrostatically adhering to the seal member 200 and the electroconductive film 220.

MODIFICATION EXAMPLES

Modification examples of the present exemplary embodiment will now be described.

First Modification Example

Figure 6:
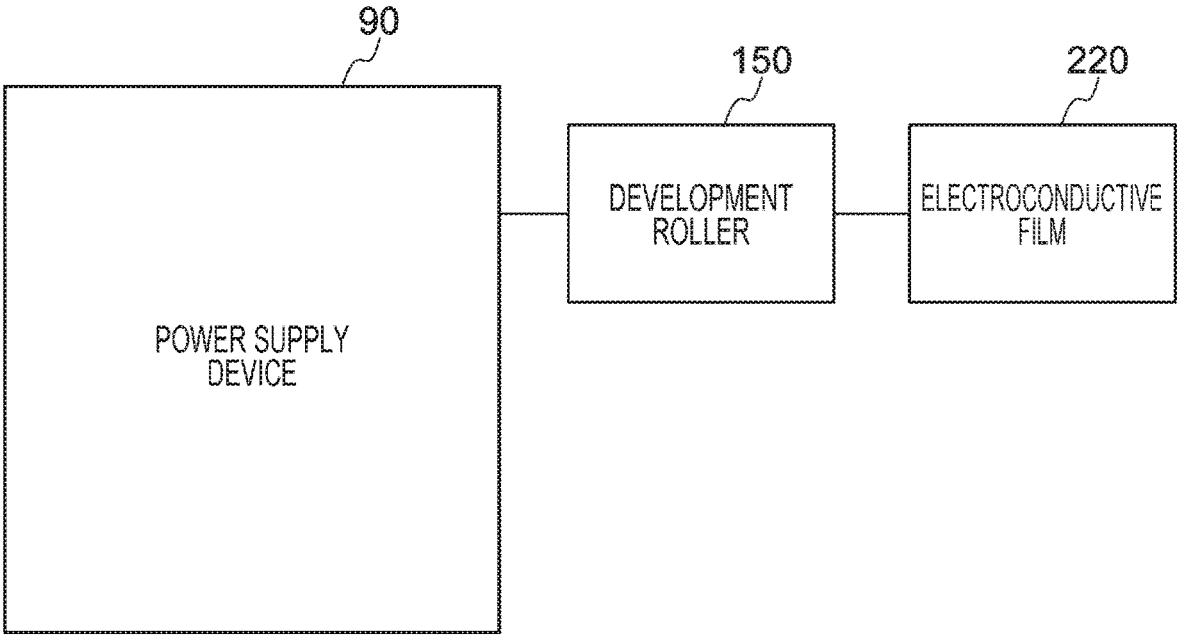
FIG. 6 is a block diagram of a power supply device, a development roller, and an electroconductive film according to a first modification example.

First, a first modification example will be described. As illustrated in FIG. 6, in the present modification example, the electroconductive film 220 is electrically connected to the development roller 150. Thus, the electroconductive film 220 receives a development bias the same as that the development roller 150 receives.

Operation

An operation of the present modification example will now be described.

As described above, a DC voltage of the development bias has the same polarity as that with which the toner M is charged. The repulsive force thus occurs between the electroconductive film 220 and the floating toner. Thus, unlike in the case where the electroconductive film 220 receives a DC voltage having a polarity opposite to the polarity with which the toner M is charged, floating toner is prevented from electrostatically adhering to the seal member 200 and the electroconductive film 220.

In the exemplary embodiment, an AC voltage is applied to the development bias. Thus, the floating toner electrically vibrates to repel the electroconductive film 220. Thus, compared to the case where the electroconductive film 220 receives only a DC voltage, floating toner is prevented from electrostatically adhering to the seal member 200 and the electroconductive film 220.

The electroconductive film 220 and the development roller 150 have the same potential, and thus, no electric field occurs between the electroconductive film 220 and the development roller 150. Thus, no force is exerted on the floating toner from an electric field. Floating toner is thus prevented from electrostatically adhering to the seal member 200 and the electroconductive film 220.

Compared to the case where the electroconductive film 220 receives a voltage from the power supply device 90, the electroconductive film 220 more easily receives a voltage the same as that the development bias.

Second Modification Example

Figure 7:
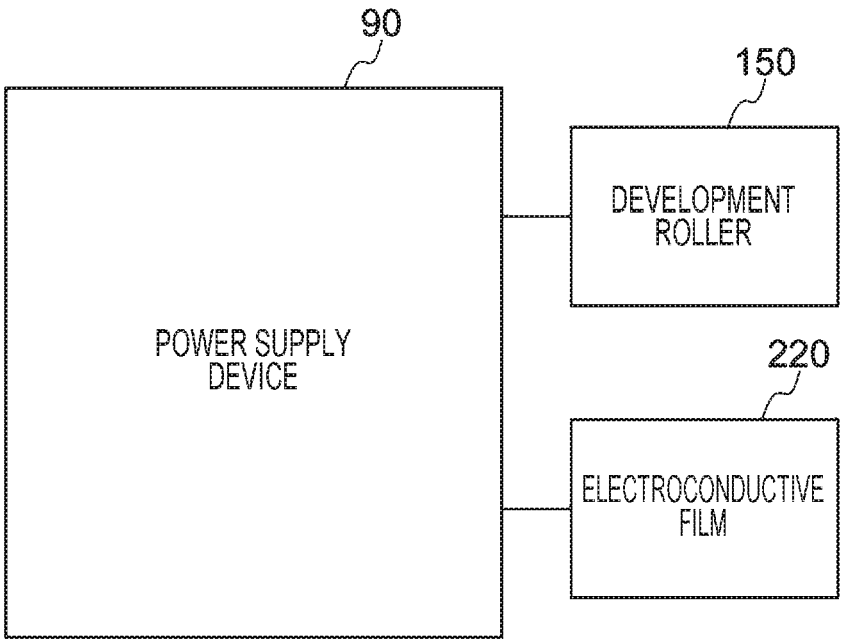
FIG. 7 is a block diagram of a power supply device, a development roller, and an electroconductive film according to a second modification example.

A second modification example will now be described. As illustrated in FIG. 7, in the present modification example, the electroconductive film 220 is electrically connected to the power supply device 90 to receive a voltage. The voltage that the power supply device 90 applies to the electroconductive film 220 is at least one of a DC voltage and an AC voltage having the same polarity as that of the toner M.

The DC voltage and the AC voltage may have a value the same as or different from the development bias.

Operation

An operation of the present modification example will now be described.

When the electroconductive film 220 receives a DC voltage having a polarity the same as that with which the toner M is charged, a repulsive force occurs between the floating toner and the electroconductive film 220. Thus, compared to the case where the electroconductive film 220 receives a DC voltage having a polarity opposite to that with which the toner M is charged, floating toner is prevented from electrostatically adhering to the seal member 200 and the electroconductive film 220.

When the electroconductive film 220 receives an AC voltage, floating toner electrically floats against the electroconductive film 220. Thus, compared to the case where the electroconductive film 220 is electrically grounded, floating toner is further prevented from electrostatically adhering to the seal member 200 and the electroconductive film 220.

When the electroconductive film 220 receives a voltage the same as that the development roller 150 receives, no force is exerted on floating toner from the electric field. Thus, floating toner is prevented from electrostatically adhering to the seal member 200 and the electroconductive film 220.

Others

The present disclosure is not limited to the above exemplary embodiments.

For example, in the exemplary embodiments and modification examples, the electroconductive film 220 electrically floats or receives a voltage, but this is not the only possible structure. The electroconductive film 220 may be electrically grounded.

For example, in the exemplary embodiments and modification examples, the first end portions 202 and 222 at which the seal member 200 and the electroconductive film 220 are bonded together are the entirety or part of a portion that does not protrude from the outer wall surface 112B, but this is not the only possible structure. Part of the portion protruding from the outer wall surface 112B may also serve as a first end portion and may be bonded. The length of the portion protruding from the outer wall surface 112B by which it is bonded is preferably equal to or greater than a half of the entirety of the protruding length.

The image forming apparatus may have any of various different structures instead of the structure of each exemplary embodiment. The present disclosure may be embodied in various different manners within the scope not departing from the gist of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device, comprising:

a developer carrier that holds a developer with which an electrostatic latent image formed on an image carrier is developed;

a sheet-shaped insulating seal member disposed above the developer carrier and at a portion that is not in contact with the held developer, the seal member having a first end portion fixed and a second end portion in contact with the image carrier; and an electroconductive film that underlies an undersurface of the seal member at a portion that is not in contact with the developer held by the developer carrier, the electroconductive film having a first end portion connected to the first end portion of the seal member and a second end portion not in contact with the image carrier, wherein side end portions of the electroconductive film protrude outward in a widthwise direction beyond side end portions of the seal member.

2. The developing device according to claim 1, wherein the second end portion of the seal member extends toward the image carrier beyond the second end portion of the electroconductive film.

3. The developing device according to claim 1, wherein the electroconductive film has flexural rigidity smaller than flexural rigidity of the seal member.

4. The developing device according to claim 3, wherein the electroconductive film has flexural rigidity equal to or smaller than a half of flexural rigidity of the seal member.

5. The developing device according to claim 1, wherein the electroconductive film electrically floats.

6. The developing device according to claim 1, wherein the electroconductive film receives a voltage.

7. The developing device according to claim 6, wherein the electroconductive film receives a DC voltage having a polarity the same as a polarity of the developer.

8. The developing device according to claim 6, wherein the electroconductive film receives an AC voltage.

9. The developing device according to claim 8, wherein the electroconductive film receives the AC voltage and a DC voltage superposed on the AC voltage, the DC voltage having a polarity the same as a polarity of the developer.

10. The developing device according to claim 6, wherein the electroconductive film receives a voltage the same as a voltage that the developer carrier receives.

11. The developing device according to claim 10, wherein the electroconductive film is electrically connected to the developer carrier.

12. An image forming apparatus, comprising:

an image forming unit that forms a developer image on an image carrier with the developing device according to claim 1, and that transfers the developer image formed on the image carrier to a recording medium; and a fixing device that fixes the developer image transferred to the recording medium onto the recording medium.

13. A developing device, comprising:

a developer carrier having a portion exposed through an opening of a development container while holding a developer on an outer circumferential surface, the developer carrier developing an electrostatic latent image formed on an image carrier with the held developer;

a sheet-shaped insulating seal member disposed above the outer circumferential surface of the exposed portion of the developer carrier and on an outer side of a virtual curve in a radial direction, the seal member having a first end portion fixed and a second end portion in contact with the image carrier, the virtual curve being concentric with the outer circumferential surface of the developer carrier and passing through an end surface of the development container defining an upper part of the opening of the development container facing the outer circumferential surface; and an electroconductive film disposed above the outer circumferential surface and on the outer side of the virtual curve, the electroconductive film underlying an undersurface of the seal member, the electroconductive film having a first end portion connected to the first end portion of the seal member and a second end portion not in contact with the image carrier.

14. A developing device, comprising:

a developer carrier that holds a developer with which an electrostatic latent image formed on an image carrier is developed;

a sheet-shaped insulating seal member disposed above the developer carrier and at a portion that is not in contact with the held developer, the seal member having a first end portion fixed and a second end portion in contact with the image carrier; and an electroconductive film that underlies an undersurface of the seal member at a portion that is not in contact with the developer held by the developer carrier, the electroconductive film having a first end portion connected to the first end portion of the seal member and a second end portion not in contact with the image carrier, wherein the electroconductive film has a thickness smaller than a thickness of the seal member.

15. The developing device according to claim 14, wherein the electroconductive film has a thickness equal to or smaller than a half of a thickness of the seal member.

* * * * *